US005901989A

United States Patent [19]

Becken et al.

[11] Patent Number: 5,901,989

[45] Date of Patent: May 11, 1999

[54] MULTI-POINT INACTIVE DOOR LOCK

[75] Inventors: Donald A. Becken, Burbank; Ivanhoe E. Chaput, Torrence, both of Calif.

[73] Assignee: Reflectolite, Sun Valley, Calif.

[21] Appl. No.: 08/895,567

[22] Filed: Jul. 16, 1997

[51] Int. Cl.[6] ..... E05C 1/06

[52] U.S. Cl. ..... 292/35; 292/DIG. 21

[58] Field of Search ..... 292/35, 36, DIG. 21, 292/341.15, 340, 341.19, 34, 139, DIG. 51, DIG. 55, 39

[56] References Cited

U.S. PATENT DOCUMENTS

| | | | |
|---|---|---|---|
| 614,144 | 12/1898 | Roth . | |
| 932,330 | 8/1909 | Rotchford . | |
| 1,051,918 | 2/1913 | Rowley . | |
| 1,070,366 | 8/1913 | Voight . | |
| 1,174,652 | 3/1916 | Banks . | |
| 3,953,061 | 4/1976 | Hansen | 292/5 |
| 4,335,816 | 6/1982 | Rager | 292/39 |
| 5,120,094 | 6/1992 | Eaton | 292/159 |
| 5,245,846 | 9/1993 | James | 292/39 |
| 5,498,038 | 3/1996 | Simon | 292/36 |
| 5,524,941 | 6/1996 | Fleming | 292/34 |
| 5,542,720 | 8/1996 | Fleming | 292/32 |

*Primary Examiner*—Steven Meyers
*Assistant Examiner*—Gary Estremsky
*Attorney, Agent, or Firm*—Hill & Simpson

[57] ABSTRACT

A lock system for the inactive door of a two door swinging combination is provided which prevents the active door from being latched or completely closed without locking the inactive door in place against the door frame and/or floor. Further, with the active door closed, the latch of the active door prevents movement of the slider of the inactive door lock mechanism and thereby prevents any unlocking of the inactive door until the latch of the active door has been removed and the active door opened.

13 Claims, 4 Drawing Sheets

MULTI-POINT INACTIVE DOOR LOCK

BACKGROUND OF THE INVENTION

The present invention relates generally to door locks and more specifically to door locks for the inactive door of a two door set of swinging doors. More specifically, the present invention relates to a lock for preventing movement of the inactive door of a two door swinging door combination prior to the opening of the active door.

Many entryways or doorways include two adjacent swinging doors that meet in the middle of the doorway as opposed to a single door. The two doors are constructed different from one another and are commonly referred to as the inactive door and the active door. The inactive door remains closed or locked for most applications. A bolt or latch is commonly used to lock the inactive door to the floor and/or to the ceiling. The locks of the inactive door may be operated manually. For example, handles for the locks may be provided in recess areas along the inside edge of the inactive door.

The active door is typically locked by securing it to the inactive door. Specifically, a latch is provided in the active door which extends outward from an inside edge of the active door and is received in a recess in the inside edge of the inactive door. The latch may be locked into place to secure the active door against the inactive door. In addition, a deadbolt may be provided to secure the active door against the inactive door.

It is important to insure that the inactive door is locked and immobilized when the active and inactive doors are in a closed position. If the inactive door is not locked or secured into place, the user may accidentally lock the active door against the inactive door and, subsequently, someone else may attempt to enter the two doors by applying pressure against either the active or the inactive doors. Because each door is attached to the door frame by hinges disposed on the outside edge surfaces of the doors, any pressure applied near the inside edge surfaces of the doors when the active door is locked to the inactive door but when the inactive door is not locked to the floor or to the door frame will result in a leveraged force imposed upon the active door lock which can result in breakage of the active door lock and damage the recess disposed in the inside edge of the inactive door.

It has been found that the error in not securing the inactive door to the door frame or to the floor is a common occurrence. Further, if the inactive door is closed, and not locked, and the active door is subsequently closed and locked to the inactive door, there is no clear visual indication that the inactive door is unlocked. Still further, when the inactive door is unlocked and the active door is locked to the inactive door, pressure applied to the inside edge of the inactive or active doors will result in some movement of the doors. A user can mistakenly interpret this limited movement as an indication that the doors are simply sticking or that there is a minor obstruction on the opposite side of the doors. Hence, the user will frequently apply additional pressure to the doors forcing the doors open and breaking the lock of the active door and causing damage to both the active and inactive doors.

Active and inactive door combinations are currently available which include matching handles. The inactive door handle is capable of activating shoot bolt locks to lock the inactive door in place. The shoot bolts may be extended or locked by pivoting the handle in the appropriate fashion. However, as discussed above, these types of inactive doors may be accidentally closed and left unlocked. The active door may then be closed and locked to the inactive door thereby creating the situation where pressure inadvertently applied to either the active or inactive door can cause the active and inactive doors to be forcibly separated causing damage to the active door lock and to the inactive door. Still further, the inactive door shoot bolts may be inadvertently retracted while the doors are closed by failing to operate the inactive door handle properly. Because there is no clear visual indication as to when the inactive door is locked, a consumer who mistakenly unlocks the inactive door may not realize the mistake.

Accordingly, there is a need for an improved inactive door lock system which prevents the inactive door from being unlocked after the active door is locked or latched to the inactive door. Further, there is a need for an improved lock system for an inactive door which blocks or prevents the active door from being locked or latched to the inactive door when the inactive door is unlocked. In other words, it would be highly beneficial to have an inactive door lock system which would prevent the active door from being locked or latched to the inactive door unless the inactive door is first properly locked or secured to the door frame and/or the floor.

SUMMARY OF THE INVENTION

The present invention satisfies the aforenoted needs by providing a lock for an inactive door of a swinging door combination that prevents the user from unlocking the inactive door when the latch of the active door is received in the recess of the inactive door. The system also prevents the latch of the active door from being received in the recess of the inactive door until the inactive door is locked. Hence, the lock system of the present invention provides a signal to the consumer that the inactive door is unlocked by preventing the active door from being latched or locked to the inactive door when the inactive door is unlocked.

In an embodiment, the lock system of the present invention comprises a handle shaft that passes through the inactive door. The shaft passes through a lower rocker and imparts pivotal movement to the lower rocker upon rotation of the handle shaft. The lower rocker engages at least one rod which, in turn, extends between the lower rocker and an upper rocker. The upper rocker is mounted onto an upper shaft for pivotal movement. An actuator is also mounted onto the upper shaft so that the pivotal movement of the lower rocker that is transmitted by the rod to the upper rocker is also transmitted to the actuator. The actuator, in turn, engages a lever upon extreme downward pivotal movement of the actuator and upon extreme upward pivotal movement of the actuator. The lever is mounted to a pin for pivotal movement and a distal end of the lever is connected to a slider disposed along the inside edge of the door. The slider is connected to at least one shoot bolt which extends outward from an upper edge of the door into the door frame or which extends downward through a lower end of the door into the floor.

In an embodiment, each end of the slider is connected to a shoot bolt whereby one shoot bolt extends upward into the door frame and one shoot bolt extends downward into a hole disposed in the floor.

In an embodiment, the handle shaft is connected directly to the actuator for transmitting rotational movement of the handle shaft to the actuator and eliminating the lower and upper rockers as well as the extension rod.

In operation, downward pivotal movement of the actuator results in an upward pivotal movement of the proximal end of the lever and slider resulting in an extension of the shoot bolt or shoot bolts to a locked position. Extreme upward pivotal movement of the actuator results in a downward pivotal movement of the distal end of the lever resulting in a downward vertical movement of the slider and a retraction of the shoot bolt or shoot bolts from the locked position to a retracted or unlocked position.

In an embodiment, an end of the slider includes a toothed rack and the shoot bolt further includes a toothed rack. The toothed rack of the slider engages a smaller gear of a pair of coaxial gears. A larger gear of the pair of coaxial gears engages the toothed rack of the shoot bolt so that vertical movement of the slider along a first smaller distance results in vertical movement of the shoot bolt along a second larger vertical distance.

In an embodiment, the actuator and upper rocker are formed from a single unified structure.

In an embodiment, the actuator includes an upper extension that engages a proximal end of the lever upon downward pivotal movement of the actuator when the lock is moved toward the locked position.

In an embodiment, the actuator includes a lower extension that engages the proximal end of the lever upon upward pivotal movement of the actuator when the lock is moved towards the retracted or unlocked position.

In an embodiment, a recessed area is disposed between the upper and lower extensions of the actuator so that a lock may pivot between the locked and retracted positions without the actuator engaging the proximal end of the lever.

In an embodiment, a spring biases the lower rocker towards a neutral position disposed between the locked and retracted positions.

In an embodiment, the lower rocker comprises two oppositely directed and radially extending arms. Each arm includes a receiving area for engaging and supporting a lower end of a rod. The upper rocker similarly includes two oppositely directed and radially extending arms that each include a receiving area for engaging an upper end of an extension rod. The lock further comprises two extension rods that extend between the lower and upper rockers on opposing sides of the handle and upper shafts.

In an embodiment, the lock of the present invention pivots from either the locked position or the unlocked or retracted position to a neutral position without causing any movement to the lever, slider or shoot bolt.

In an embodiment, the slider is attached to an upper shoot bolt that locks an upper end of the inactive door to the door frame as well as a lower shoot bolt that locks a lower end of the inactive door to the floor.

In an embodiment, the active door cannot be closed until the inactive door is in the locked position.

In an embodiment, the active door cannot be latched to the inactive door until the inactive door is in the locked position.

It is therefore an advantage of the present invention to provide a lock system for an inactive door of a two-door swinging door system which prevents the inactive door from being unlocked when the active door is latched or locked to the inactive door.

Another advantage of the present invention is that it provides a lock system for an inactive door of a swinging door system which prevents the active door from being fully closed or latched when the inactive door is unlocked or when the shoot bolts of the inactive door are in the retracted position.

Another advantage of the present invention is that it prevents the inactive door of a swinging door system from being opened prior to the unlocking and opening of the active door.

Still another advantage of the present invention is that it prevents damage to the inactive door and active door by opening the inactive door prior to the unlocking and opening of the active door.

Yet another advantage of the present invention is that it provides a signal to the user that the inactive door is unlocked because the inactive door prevents the active door from being fully closed or latched to the inactive door when the inactive door is in an unlocked or retracted position.

Yet another advantage of the present invention is that the handle of the lock system returns to a neutral or horizontal position after the handle is moved to a locked position without unlocking the shoot bolts.

And another advantage of the present invention is that the handle of the lock system returns to a neutral or horizontal position after the handle is moved to an unlocked or retracted position without returning or moving the shoot bolts towards the locked position.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
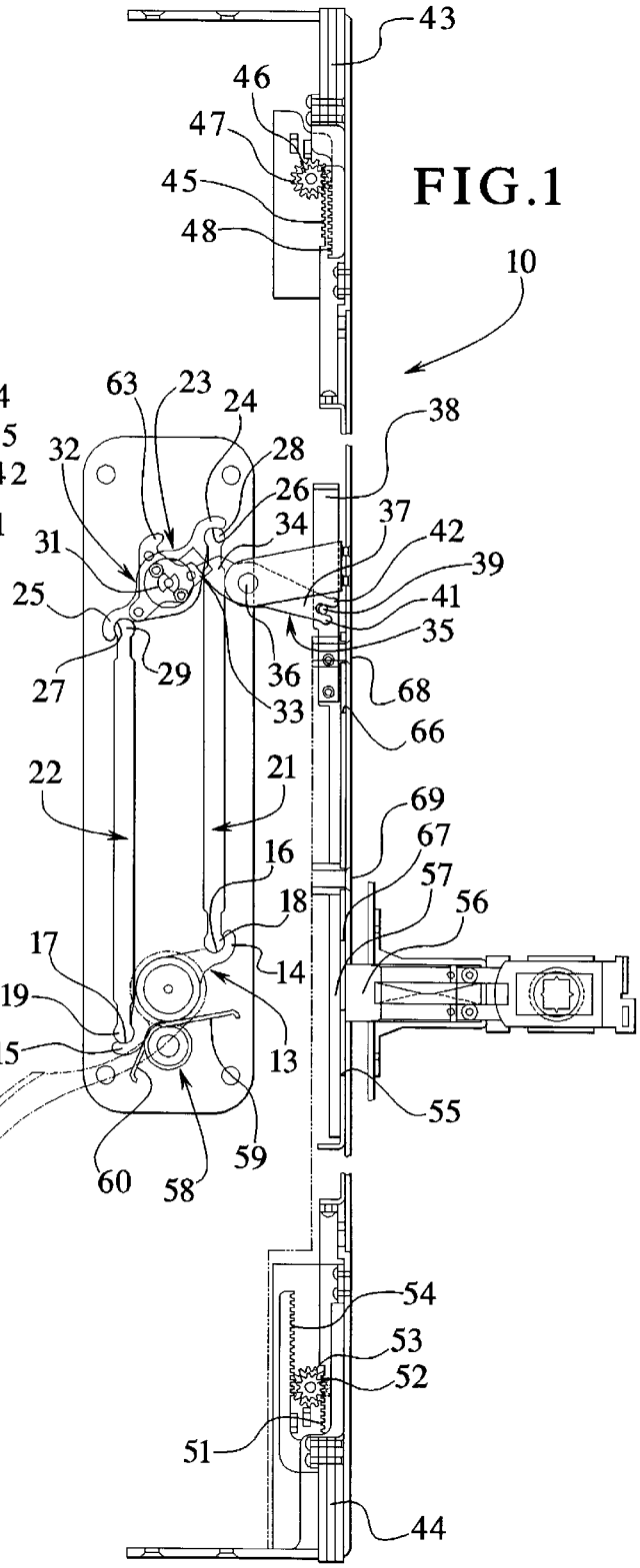
FIG. 1 is a partial front elevational view of a lock system for an inactive door of a swinging door system made in accordance with the present invention particularly illustrating the system with the handle rotated to the retracted position.

Turning to FIG. 1, a lock system 10 for an inactive door 11 (see FIG. 7) of a two door swinging door system (not shown) is illustrated. Viewing the inactive door from the inside, a handle 12 is mounted onto a handle shaft (not shown) which passes through the inactive door. Also mounted to the handle shaft is a lower rocker 13 which includes arms 14, 15. The arms 14, 15 each include receiving areas 16,17 that accommodate the ends 18, 19 of the rods 21, 22. The rods 21, 22 extend from the lower rocker 13 to the upper rocker 23 which also includes two oppositely directed radially extending arms 24, 25. Each arm 24, 25 includes a downwardly facing receiving area 26, 27 respectively for accommodating the upper ends 28, 29 of the rods 21, 22 respectively. Accordingly, the pivotal movement of the lower rocker 13 which imposed by movement of the handle 12 is transferred to the upper rocker 23 by the rods 21, 22.

The upper rocker 23 is mounted onto a non-circular shaft 31 for pivotal movement. Also mounted to the shaft 31 is a cam actuator 32. Upon extreme upward pivotal movement in the counter-clockwise direction as shown in FIG. 1, a lower extension 33 of the cam actuator 32 engages a proximal end 34 of a lever 35. The lever 35 is mounted onto a pin 36 for pivotal movement. The upward pivotal movement of the proximal end 34 of the lever 35 results in a downward pivotal movement of the distal end 37 of the lever 35. The distal end 37 of the lever 35 is attached or otherwise engaged to a slider 38 by way of the pin 39 being disposed between the fingers 41, 42 of the distal end 37 of the lever 35.

Accordingly, as illustrated in FIG. 1, downward movement of the handle 12 to the position shown in FIG. 1 results in the upward pivotal movement of the arm 14 of the lower rocker 13 as shown. The counter-clockwise pivotal movement of the rocker 13 is transmitted to the actuator 32 by way of the rods 21, 22 and upper rocker 23. As the lower extension 33 of the actuator 32 pushes the proximal end 34 of the lever 35 upward, the distal end 37 of the lever 35 pushes the slider 38 downward to the position shown FIG. 1. In this position, the shoot bolts 43, 44 which are attached to opposing ends of the slider 38 are retracted.

Specifically, still referring to FIG. 1, downward movement of the slider 38 causes the toothed rack 45 to move downward because it is attached to the slider 38. Downward vertical movement of the toothed rack 45 causes the coaxial gears shown at 46, 47 to rotate. Rotation of the smaller gear 46 which is meshed with the toothed rack 45 imparts rotation to the large gear 47 which is meshed with the toothed rack 48 which is attached to the shoot bolt 43. Thus, downward movement of the slider 38 and toothed rack 45 by a smaller first vertical distance results in downward movement of the shoot bolt 43 and toothed rack 48 by a larger second vertical distance. In this manner, the shoot bolt 43 moves a vertical distance that is greater than the vertical distance moved by the slider 38.

Similarly, still referring to FIG. 1, with respect to the shoot bolt 44 shown at the bottom of FIG. 1, downward movement of the slider 38 results in a downward movement of the toothed rack 51 which imparts rotation to the small gear 52. The small gear 52 imparts rotation to the larger gear 53 because the two gears are coaxial and the counter-clockwise rotation of the larger gear 53 results in an upward vertical movement of the toothed rack 54 which is meshed with the large gear 53. Because the toothed rack 54 is attached to the shoot bolt 44, the upward movement of the toothed rack 54 causes the shoot bolt 44 to be withdrawn upward to the retracted position shown in FIG. 1. It will be noted that the coaxial gear pairs 46, 47 and 52, 53 are each mounted on common axles and attached to a fixed structure so that the gears maintain their vertical position.

The slider 38 includes an aperture shown at 55 which is intended to accommodate the latch 56 of the active door (not shown in FIG. 1) when the inactive door lock system 10 is in the locked position.

However, as shown in FIG. 1, the lock system 10 is in the open, unlocked or retracted position. Accordingly, the slider 38 prevents entry of the spring biased latch 56 from extending into a recess 57 disposed in the inactive door. Accordingly, in the retracted position shown in FIG. 1, the latch 56 of the active door engages the slider 38 and the active door cannot be latched or completely shut. This is an important signal for the consumer because it tells the consumer that the inactive door lock system 10 is not locked but is in the retracted position as shown in FIG. 1. Accordingly, in order to fully close the active door and have the latch 56 of the active door received in the recess 57 disposed in the inactive door, the lock system 10 must be moved to the locked position shown in FIG. 3 which will be discussed in detail below.

Figure 2:
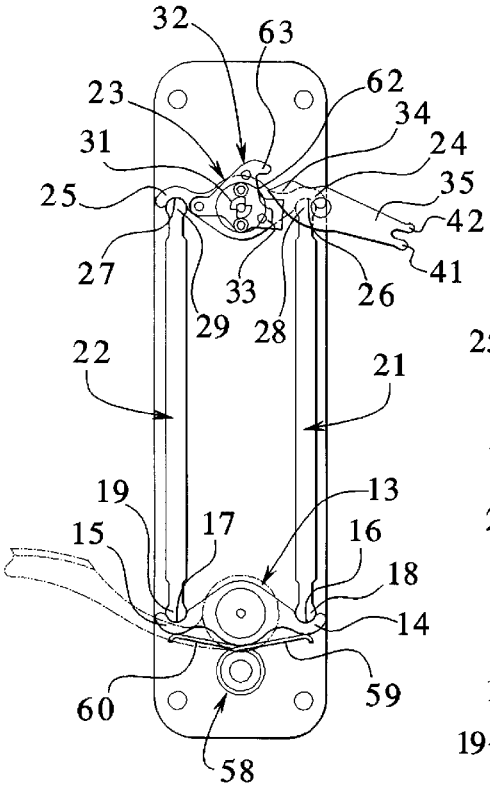
FIG. 2 is a partial front elevational view of the system shown in FIG. 1 after the handle is rotated back to the neutral position.

Turning to FIG. 2, an important feature of the present invention is the return of the handle 12 to the horizontal or neutral position shown in FIG. 2. Specifically, a spring 58 is provided with arms 59, 60. The arms 59, 60 engage the undersides of the arms 14, 15 respectively of the lower rocker 13 and, when the handle 12 and lower rocker 13 are pivoted out of the horizontal or neutral position shown in FIG. 2, the spring biasing action of the arms 59, 60 of the spring 58 on the underside of the arms 14, 15 of the lower rocker 13 returns the lower rocker 13 to the horizontal position shown in FIG. 2.

Further, still referring to FIG. 2, the actuator 32 is shaped so that there is a recess 62 disposed between the lower extension 33 and upper extension 63. The recess 62 enables the actuator 32 to pivot downward to the position shown in FIG. 2 from the position shown in FIG. 1 without engaging the proximal end 34 of the lever 35. Thus, the lever 35 does not move during the return of the lock system 10 to the neutral position shown in FIG. 2 from the retracted position shown in FIG. 1. Because the lever 35 does not move, the slider 38 and shoot bolts 43, 44 do not move as well.

Figure 3:
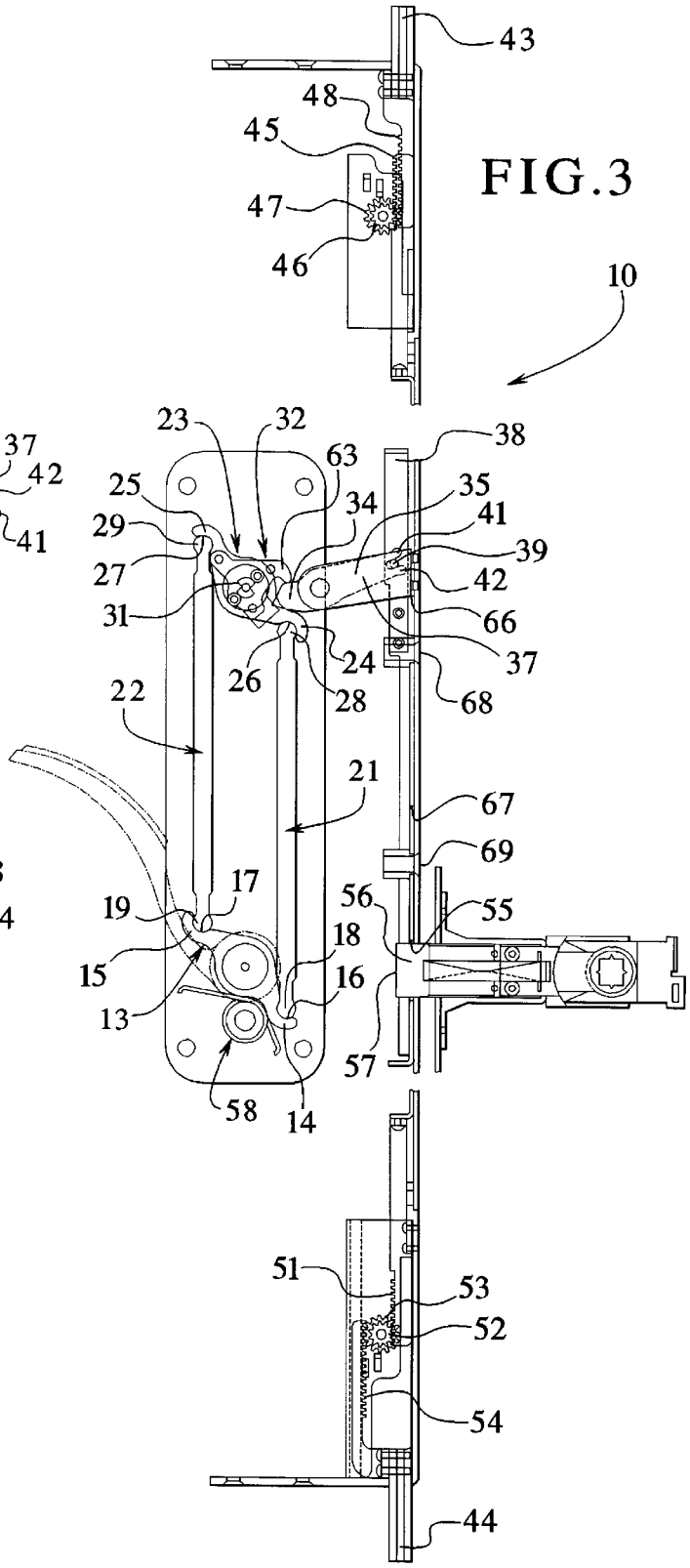
FIG. 3 is a partial front elevational view of the lock system first shown in FIG. 1 particularly illustrating the handle and lock system rotated to the locked position.

Turning to FIG. 3, the lock system 10 has been rotated to the locked position. Specifically, the handle 12 has been pivoted upward causing the downward or clockwise rotation of the lower rocker 13. Under an upward force imposed by the rod 22, the upper rocker 23 also pivots downward in the clockwise direction which eventually causes the upper extension 63 of the actuator 32 to engage the proximal end 34 of the lever 35 thereby causing the lever 35 to pivot upward or in the counter-clockwise direction shown in FIG. 3. As a result, the distal end 37 of the lever 35 pulls the slider 38 upward to the position shown in FIG. 3. The aperture 55 disposed in the slider 38 is then disposed in front of the latch 56 of the active door. The spring biased latch 56 is then free to proceed through the aperture 55 in the slider 38 and into the recess 57 disposed in the inactive door. Hence, the active door may be closed and latched when the inactive door lock system 10 is in the locked position as shown in FIG. 3.

The resulting upward movement of the slider 38 causes the toothed rack 45 to move upward which thereby imparts an upward movement to the toothed rack 48 by way of the gears 46, 47. As a result, the shoot bolt 43 is extended upward. In contrast, the upward movement of the toothed rack 51 results in a downward movement of the toothed rack 54 by way of the gears 52, 53. Therefore, as a result of the upward movement of the slider 38, the shoot bolt 44 extends downward to the locked position shown in FIG. 3.

Still referring to FIG. 3, it will be noted that the shoot bolts 43, 44 cannot be retracted while the latch 56 is disposed in the aperture 55. Specifically, the position of the latch 56 in the aperture 55 prevents downward movement of the slider 38 (or any substantial vertical movement of the slider 38 for that matter). Hence, until the active door is opened and the latch 56 is removed from the aperture 55, the inactive door lock system 10 cannot be unlocked or otherwise rotated out of the locked position shown in FIG. 3.

Figure 4:
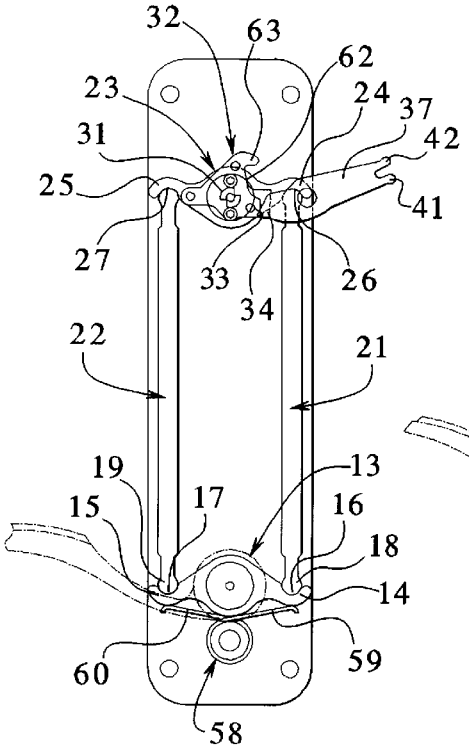
FIG. 4 is a partial front elevational view of the lock system shown in FIG. 3 after the handle has rotated back to the neutral position.

Referring to FIG. 4, the action of the spring 58 causes the lower rocker 13, rods 21, 22, upper rocker 23 and actuator 32 to return to the horizontal or neutral position shown in FIG. 4 without moving the lever 35. Specifically, the upper extension 63 of the actuator 32 can pivot away from the proximal end 34 of the lever 35 without another part of the actuator 32 engaging the proximal end 34 of the lever 35 due to the recess 62. In the horizontal or neutral position shown in FIG. 4, with the lever 35 rotated counter-clockwise upward, the lower extension 33 may slightly engage the proximal end 34 of the lever 35 but no substantial movement of the lever is effectuated due to the position of the latch 56 in the aperture 55 of the spacer 38 as shown in FIG. 3.

Hence, after rotation of the handle 12 to the retracting position as shown in FIG. 1 and after rotation of the handle to the locked position as shown in FIG. 3, the handle returns to a neutral or horizontal position as shown in FIGS. 2 and 4 respectively.

Figure 5:
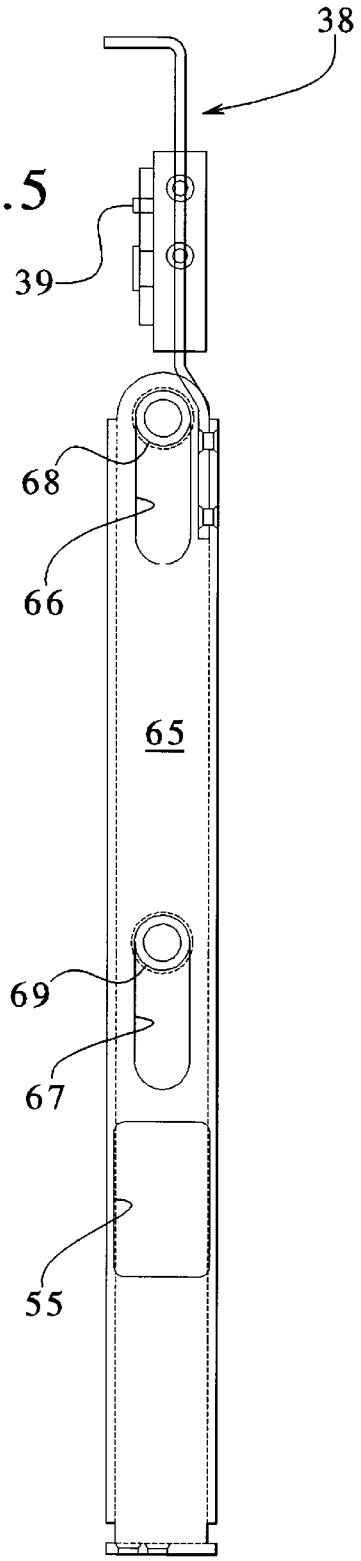
FIG. 5 is a partial side plan view of the slider element of the lock system first shown in FIG. 1.
Figure 6:
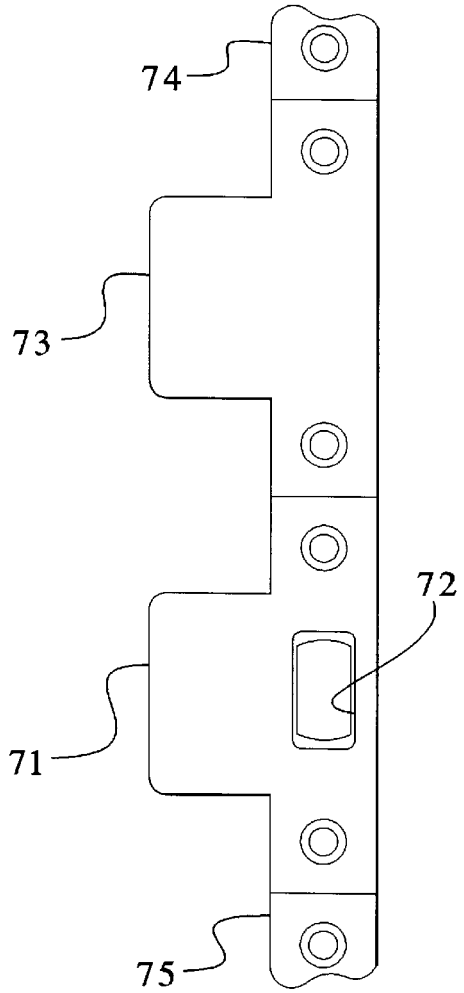
FIG. 6 is a side plan view of the latch plate and cover plate assembly for the inactive door lock system of the present invention.
Figure 7:
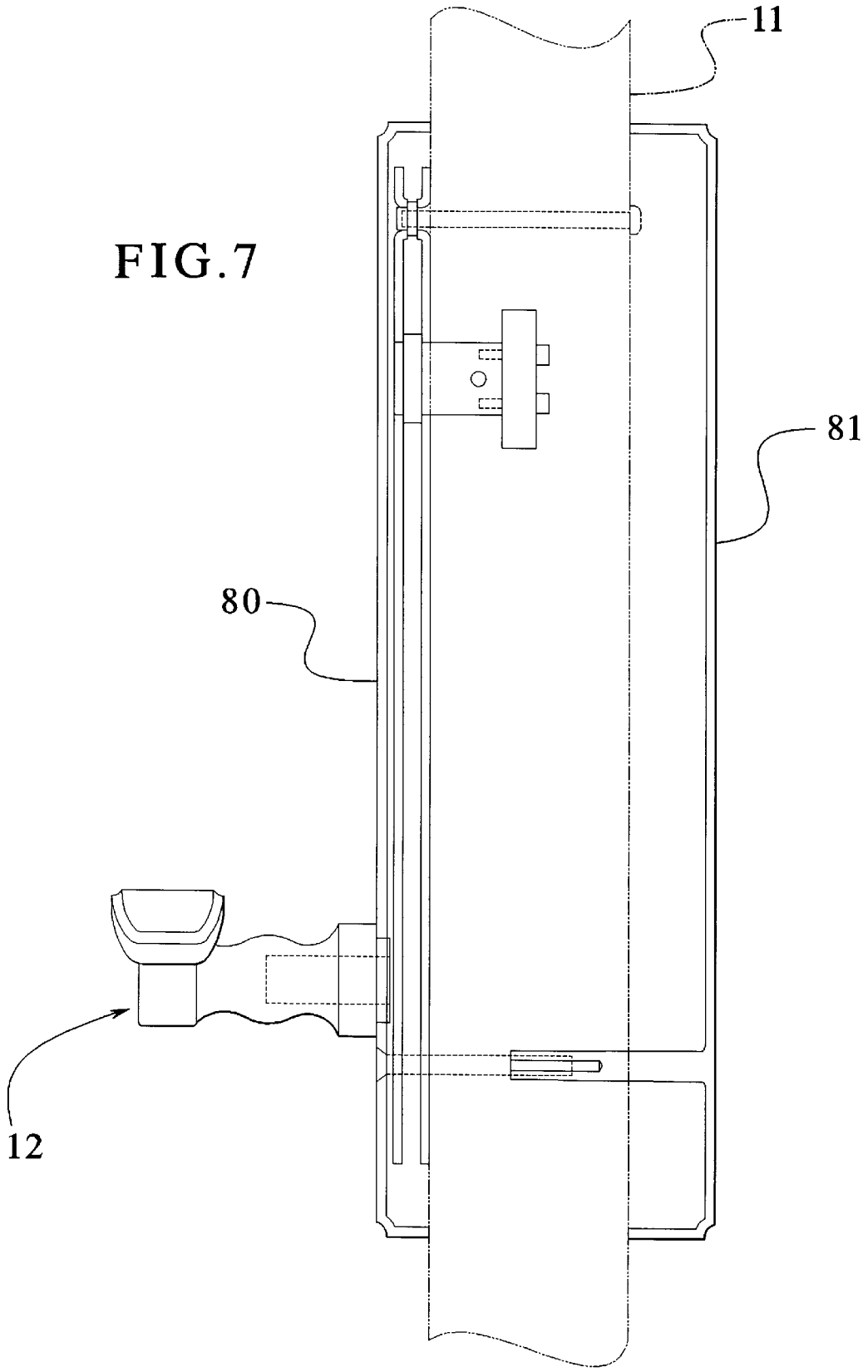
FIG. 7 is a partial side sectional view of the lock system of the present invention.

Turning to FIG. 5, the slider 38 is illustrated in greater detail. Specifically, a lower panel 65 of the slider 38 includes slots 66, 67 which slide upward and downward over guides 68, 69 respectively. The panel 65 also includes the aperture 55 through which the latch 56 (see FIGS. 1 and 3) extends. Turning to FIG. 6, a latch plate 71 is shown which includes an aperture 72 for accommodating the latch 56 of the active door. When the slider 38 (see FIG. 5) is in the locked position (see FIG. 3), the latch 56 extends through the aperture 72 and the aperture 55 to latch or fully close the active door against the inactive door. An additional latch plate is shown at 73 that does not include an aperture. The latch plate 73 is intended to depress a spring biased latch or plunger for a multiple deadbolt locking system for the active door. Additional end plates are shown at 74, 75 to protect the edge surface of the inactive door 11 (see FIG. 7). Turning to FIG. 7, the lock system 10 of the present invention may include matching inner and outer escutcheons 80, 81.

From the above description, it is apparent that the objects and advantages of the present invention have been achieved. While only certain embodiments have been set forth, alternative embodiments and various modifications will be apparent from the above description to those skilled in the art. For example, a single rod connecting element may be employed between the lower rocker 13 and upper rocker 23. Further, the upper rocker 23 and actuator 32 can be consolidated into a single structure. Still further, the cam actuator 32 may be mounted directly to the handle shaft thereby eliminating the upper displacement of the cam actuator 32 and therefore the rods 21, 22 and upper and lower rockers 23, 13. The employment of the rods 21, 22 places the handle 12 at the same elevation or vertical position as the corresponding handle of the active door (not shown). These and other alternatives are considered equivalents and within the spirit and scope of the present invention.

What is claimed is:

1. A door assembly comprising:

an active door pivotally mounted to one side of a door frame and an inactive door pivotally mounted to an opposing side of the door frame, the active door comprising an edge surface, the inactive door comprising an edge surface, the edge surface of the active door being in an abutting engagement with the edge surface of the inactive door when the active and inactive doors are in a closed position, the active door further comprising a latch that extends through the edge surface of the active door, the edge surface of the inactive door further comprising a recess for receiving the latch of the active door when the active and inactive doors are in the closed position, the inactive door further comprising a lock for securing the inactive door against the door frame, the lock comprising a handle shaft operatively connected to an actuator whereby pivotal movement of the handle shaft is imparts pivotal movement to the actuator, the actuator engaging a lever, the lever being pivotally mounted to a pin, the lever engaging a vertically oriented slider disposed parallel to and inside of the edge surface of the inactive door, the slider being connected to at least one shoot bolt, the slider comprising an aperture that is in matching registry with the recess of the inactive door when the inactive door is in the locked position, the slider further comprising a solid portion that is in at least partial matching registry with the recess of the inactive door when the inactive door is in the unlocked position, the aperture of the slider accommodating the latch of the active door when the inactive door is in the locked position and when the active door is closed, reception of the latch in the aperture of the slider preventing vertical movement of the slider and the shoot bolt.

2. The door assembly of claim 1 wherein the handle shaft passes through and is connected to a lower rocker, the lower rocker engaging at least one rod, the rod extending between the lower rocker and an upper rocker whereby the rod imparts pivotal movement from the lower rocker to the upper rocker, the upper rocker being mounted on an upper shaft, the upper shaft passing through the upper rocker and the actuator.

3. The door assembly of claim 2 further comprising a spring that engages the lower rocker and biases the lower rocker, handle shaft, rod, upper rocker, upper shaft, and actuator towards a neutral position between the retracted and locked positions.

4. The door assembly of claim 3 wherein the actuator further comprises a lower extension and an upper extension with a recessed section disposed therebetween, and wherein after the actuator has rotated downward thereby imparting upward pivotal movement to the lever and vertical movement to the slider and shoot bolt to the locked position, the spring biases the actuator upward to a neutral position where the lever is disposed in the recessed section, and wherein after the actuator has rotated upwards thereby imparting downward pivotal movement to the lever and vertical movement to the slider and shoot bolt to the locked position, the spring biases the actuator downward to the neutral position where the lever is disposed in the recessed section.

5. The door assembly of claim 1 wherein the actuator further comprises an upper extension for engaging a proximal end of the lever and imparting upward pivotal movement to the lever upon downward pivotal movement of the actuator, the actuator further comprising a lower extension for engaging the proximal end of the lever and imparting downward pivotal movement to the lever upon upward pivotal movement of the actuator, the actuator further comprising a recessed section between the upper and lower extensions, the recessed section not engaging the proximal end of the lever.

6. The door assembly of claim 1 wherein the actuator further comprises an upper extension for engaging a proximal end of the lever and imparting upward pivotal movement to the lever upon downward pivotal movement of the actuator, the actuator further comprising a lower extension for engaging the proximal end of the lever and imparting downward pivotal movement to the lever upon upward pivotal movement of the actuator, the actuator further comprising a recessed section between the upper and lower extensions, the recessed section not engaging the proximal end of the lever upon pivotal movement of the actuator whereby the actuator can pivot upward from the locked position to a neutral position with the recessed section disposed adjacent to the proximal end of the lever without imparting movement to the lever and whereby the actuator can pivot downward from the retracted position to the neutral position with the recessed section disposed adjacent to the proximal end of the lever without imparting movement to the lever.

7. A door assembly comprising:

an active door pivotally mounted to one side of a door frame and an inactive door pivotally mounted to an opposing side of the door frame, the active door comprising an edge surface, the inactive door comprising an edge surface, the edge surface of the active door being in an abutting engagement with the edge surface of the inactive door when the active and inactive doors are in a closed position, the active door further comprising a latch that extends through the edge surface of the active door, the edge surface of the inactive door further comprising a recess for receiving the latch of the active door when the active and inactive doors are in the closed position, the inactive door further comprising a lock for securing an inactive door against the door frame, the lock comprising a handle shaft, the handle shaft passing through and engaging a lower rocker, the lower rocker comprising two oppositely directed radially extending arms, each arm of the lower rocker including an upwardly facing receiving area, the upwardly facing receiving area of each arm engaging an upwardly extending rod, the rods extending between the lower rocker and an upper rocker and transmitting pivotal movement of the lower rocker to the upper rocker, the upper rocker being mounted on and engaging an upper shaft, the upper rocker comprising two oppositely directed radially extending arms, each arm of the upper rocker including a downwardly facing receiving area for accommodating an end of one of the rods, the upper shaft also passing through and engaging an actuator, the actuator engaging a lever, the lever being mounted to a pin for pivotal movement, the lever having a distal end that engages a vertically oriented slider disposed parallel to and inside of the edge surface of the door, the slider being connected to at least one shoot bolt, the slider including an aperture for accommodating the latch of the active door and a solid portion for blocking outward movement of the latch of the active door, reception of the latch in the aperture of the slider preventing vertical movement of the slider and the shoot bolt.

8. The door assembly of claim 7 wherein the lock further comprises a spring that engages the lower rocker and biases the lower rocker, handle shaft, rods, upper rocker, upper shaft, and actuator towards a neutral position between the retracted and locked positions.

9. The door assembly of claim 7 wherein after the actuator has rotated downward thereby imparting upward pivotal movement to the lever and vertical movement to the slider and shoot bolt to the locked position, the spring biases the actuator upward to the neutral position without engaging the lever and imparting pivotal movement thereto, and wherein after the actuator has rotated upwards thereby imparting downward pivotal movement to the lever and vertical movement to the slider and shoot bolt to the locked position, the spring biases the actuator downward to the neutral position without engaging the lever and imparting pivotal movement thereto.

10. The door assembly of claim 8 wherein the actuator further comprises an upper extension for engaging a proximal end of the lever and imparting upward pivotal movement to the lever upon downward pivotal movement of the actuator, the actuator further comprising a lower extension for engaging the proximal end of the lever and imparting downward pivotal movement to the lever upon upward pivotal movement of the actuator, the actuator further comprising a recessed section between the upper and lower extensions, the recessed section not engaging the proximal end of the lever.

11. The door assembly of claim 7 wherein the actuator further comprises an upper extension for engaging a proximal end of the lever and imparting upward pivotal movement to the lever upon downward pivotal movement of the actuator, the actuator further comprising a lower extension for engaging the proximal end of the lever and imparting downward pivotal movement to the lever upon upward pivotal movement of the actuator, the actuator further comprising a recessed section between the upper and lower extensions, the recessed section not engaging the proximal end of the lever upon pivotal movement of the actuator whereby the actuator can pivot upward from the locked position to the neutral position with the recessed section disposed adjacent to the proximal end of the lever without imparting movement to the lever and whereby the actuator can pivot downward from the retracted position to the neutral position with the recessed section disposed adjacent to the proximal end of the lever without imparting movement to the lever.

12. The door assembly of claim 7 wherein the upper shaft has a non-circular cross section which is received in matching non-circular holes in the upper rocker and actuator.

13. The door assembly of claim 7 wherein the shoot bolt comprises a bolt section that is attached to a toothed rack, the slider also comprising a toothed rack, the lock further comprising a pair of gear wheels mounted to a common axle, the pair of gear wheels comprising a first small gear wheel engaging the toothed rack of the slider and a second larger gear wheel engaging the toothed rack of the shoot bolt whereby vertical movement of the slider of a first distance imparts vertical movement of a second distance to the shoot bolt, the second distance being greater than the first distance.

* * * * *